US008596168B1

(12) United States Patent
Row

(10) Patent No.: US 8,596,168 B1
(45) Date of Patent: Dec. 3, 2013

(54) OPEN END RATCHETING WRENCH

(71) Applicant: Chi Sung Row, Norcross, GA (US)

(72) Inventor: Chi Sung Row, Norcross, GA (US)

( * ) Notice: Subject to any disclaimer, the term of this patent is extended or adjusted under 35 U.S.C. 154(b) by 0 days.

(21) Appl. No.: 13/684,517

(22) Filed: Nov. 24, 2012

(51) Int. Cl.

| | |
|---|---|
| ***B25B 13/58*** | (2006.01) |
| ***B25B 13/00*** | (2006.01) |
| ***B25B 13/28*** | (2006.01) |
| ***B25B 13/12*** | (2006.01) |
| ***B25B 13/46*** | (2006.01) |

(52) U.S. Cl.
USPC ..... 81/58.2; 81/180.1; 81/59.1; 81/111; 81/179; 81/62; 81/183

(58) Field of Classification Search
USPC ..... 81/180.1, 58.2, 59.1, 111, 179, 62, 183
See application file for complete search history.

(56) References Cited

U.S. PATENT DOCUMENTS

| | | | | |
|---|---|---|---|---|
| 2,550,010 | A | 4/1951 | Kavalar | |
| 2,730,000 | A | 7/1953 | Crittenden, Jr. | |
| 2,701,977 | A * | 2/1955 | Stone | 81/63.2 |
| 2,978,081 | A * | 4/1961 | Lundin | 192/43.1 |
| 3,145,594 | A * | 8/1964 | Peters | 81/63 |
| 3,161,091 | A | 12/1964 | Searcy | |
| 3,233,481 | A * | 2/1966 | Bacon | 81/63 |
| 3,250,157 | A * | 5/1966 | Badger | 81/63 |
| 3,356,117 | A * | 12/1967 | Wagner | 81/33 |
| 3,927,582 | A | 12/1975 | Herteleady et al. | |
| 4,324,159 | A | 4/1982 | Wrobbel | |
| 4,574,665 | A | 3/1986 | Blachly | |
| 5,174,176 | A * | 12/1992 | Krivec | 81/63.1 |
| 5,832,795 | A | 11/1998 | Reynolds | |
| 7,478,577 | B1 * | 1/2009 | Wheeler | 81/63 |

FOREIGN PATENT DOCUMENTS

| | | |
|---|---|---|
| GB | 2486830 | 6/2012 |

* cited by examiner

*Primary Examiner* — Monica Carter
*Assistant Examiner* — Dabby Hong
(74) *Attorney, Agent, or Firm* — Mark V. Loen

(57) ABSTRACT

The invention comprises a ratchet style open end wrench which incorporates an assembly to provide a torqueing function and ratchet effect. The assembly includes a wrench body capable of providing torque delivery through two or more rotating cylindrical cams which contact the nut. The cylindrical cams then rotate when reversing the direction of the wrench assembly so that a cutout portion of the cylindrical cams allows the nut points to pass by. In one embodiment, the direction of the ratchet effect is reversible by a reversing arc wire which is activated by use of a lever.

15 Claims, 10 Drawing Sheets

OPEN END RATCHETING WRENCH

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed toward open ended wrenches, in particular, to wrenches that incorporate elements and features that are useful for allowing a wrench to loosen/tighten a bolt (or nut) without removing the wrench from the fitted position on the bolt.

(2) Description of Related Art

Wrenches are useful for a variety of tightening or loosening situations when applied to nuts and bolts, and some are designed to provide a ratcheting effect. However, open ended wrenches are not easily configured to a ratcheting method, and it is difficult to incorporate a ratcheting method that is also reversible into an open ended wrench.

For example, U.S. Pat. No. 4,574,665 teaches the use of an open end wrench along with multipoint cylinders around the perimeter of a bolt that is being loosened. The cylinders rotate about an offset axis, and recess between two chambers around the perimeter of the bolt for the ratchet effect. In one chamber, i.e., the tighter tool—bolt chamber clearance, the torque is applied. In the other chamber, the cylinder recess when the wrench is reversed in direction. This offset rotation is undesirable when the rotating cylinders bend, as may be caused by an applied user torque, which will cause the wrench to fail as the cylinders may fail to reposition. Also the cylinders tend to engage the bolt at the corners or points, which are often rounded, and is a less reliable method of rotating a bolt. U.S. Pat. No. 2,550,010 has similar cylinder features and has similar concerns.

It is desirable to incorporate a reversible feature for an open end ratchet wrench, as it is also frequently the case where a wrench is put on a nut only to discover that the bolt must be turned in the other direction. This occurs when the bolt is at an awkward position with respect to the user of the wrench, and where it is not instantly obvious which way the bolt should be turned. A reversible feature prevents the need for the user to remove the wrench and re-insert it back on the bolt, simplifying the task of loosening or tightening.

BRIEF SUMMARY OF THE INVENTION

The invention comprises a ratchet style open end wrench assembly which incorporates an assembly to provide a torqueing function and ratchet effect. The assembly includes a wrench body capable of providing torque delivery through two or more rotating cylindrical cams which contact the nut. The cylindrical cams then rotate when reversing the direction of the wrench assembly so that a cutout portion of the cylindrical cams allows the nut points to pass by. In one embodiment, the direction of the ratchet effect is reversible by a reversing arc wire which is activated by use of a lever.

BRIEF DESCRIPTION OF THE SEVERAL VIEWS OF THE DRAWING(S)

DETAILED DESCRIPTION OF THE INVENTION

The invention will provide torque capability in addition to ratchet capability, and additionally, reversible ratchet capability.

The invention will be compact in design, provided, however, that suitable materials are selected. The top and bottom cover plates, the spacer plates, and cylindrical cam design are important aspects that require careful thought and consideration to keep the design clean.

Figure 1:
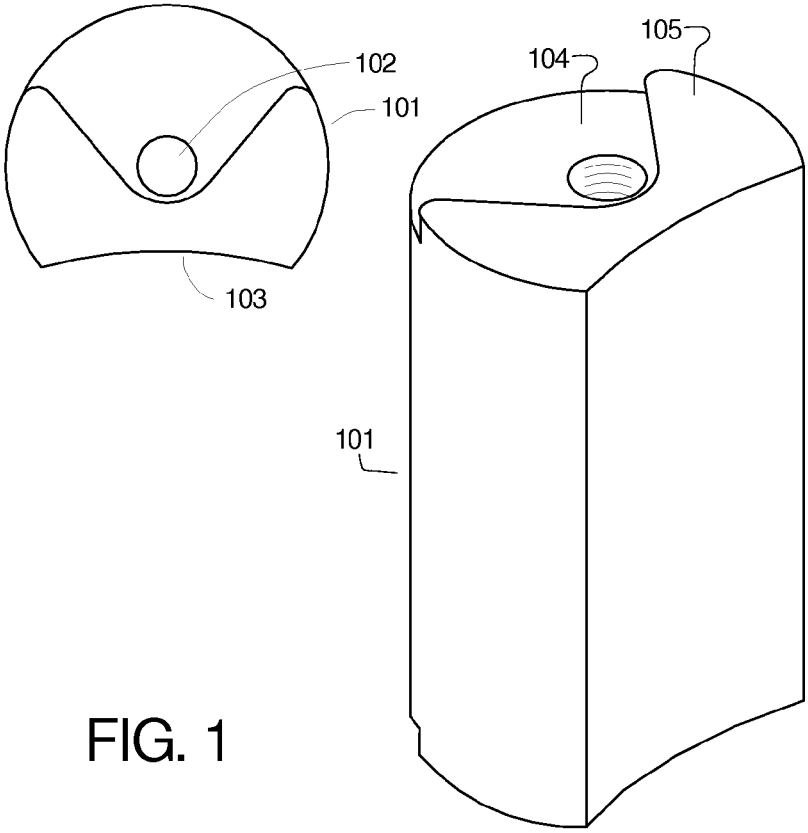
FIG. 1 shows a rotating cylindrical cam of the invention including the cutout area.

FIG. 1 shows an isometric view of a rotating cylindrical cam 101 and a top view. The rotating cylindrical cam includes a machined area 103 which is used for the ratchet effect and allows the bolt points to pass by the cam, and press against it to rotate it. The area could be in the shape of a circle segment (preferred) or in the shape of a straight line depending upon clearance tolerances between the nut and the wrench opening, or the size of the cylindrical cam. A hole 102 is provided for a pin (see FIG. 5). A recess area 104 is machined below the top area of the cylindrical cam 105 (and also on the opposite end) so that the cam will rotate when used with an associated right angle spring (see FIG. 2). Each cylindrical cam will have one right angle spring.

Figure 2:
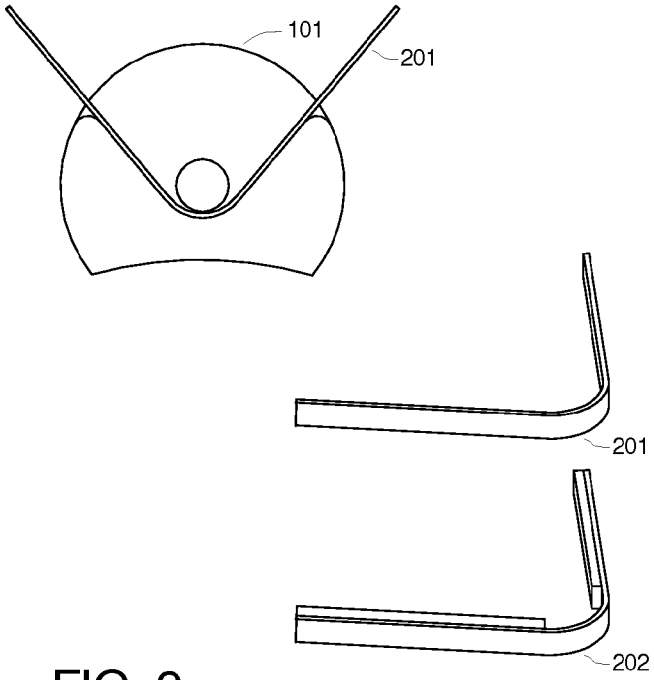
FIG. 2 shows the right angle torque spring that is use to create the ratchet effect.

FIG. 2 shows two embodiments of a right angle torque spring 201, 202 that are used to create the ratchet effect. Its location in the lower recessed area of the cylindrical cam (Area 104 in FIG. 1) and pressed against the sides of the top area of the cylindrical cam (area 105 in FIG. 1) is also illustrated. The right angle torque spring may be stiffened or weakened by varying the thickness and material used, and in one embodiment is a wire rather than the flat spring illustrated. In another embodiment, the right angle torque spring is a built up spring 202 where the thickness of the straight portions is greater.

Figure 3A:
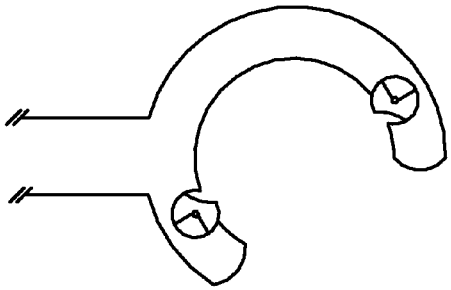
FIG. 3A-3C shows how various cylindrical cam sizes would be used with a wrench body, depending on the desired torque.
Figure 3B:
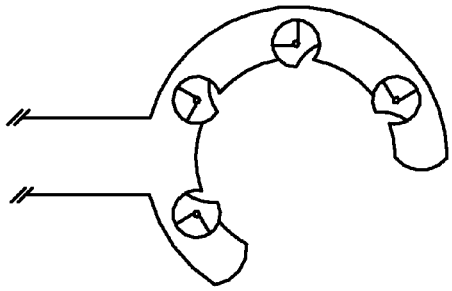
Figure 3C:
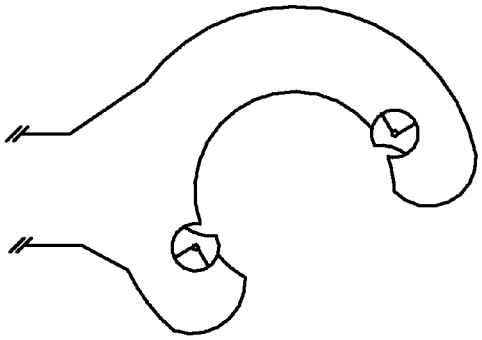

FIG. 3A shows a light torque wrench body with two cylindrical cams. As illustrated, the actual strength of the assembly would be lowered as the body somewhat compromised due to the relatively large cylindrical cams installed. FIG. 3B is a wrench body with three cylindrical cams installed. FIG. 3C shows a stronger wrench with two cylindrical cams installed. The strength of the wrench is improved by adding additional plates as illustrated in FIG. 4.

Figure 3D:
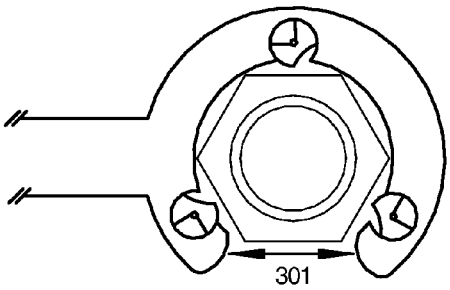
FIGS. 3D-3E show a cylinder cam configuration for a flare nut wrench.
Figure 3E:
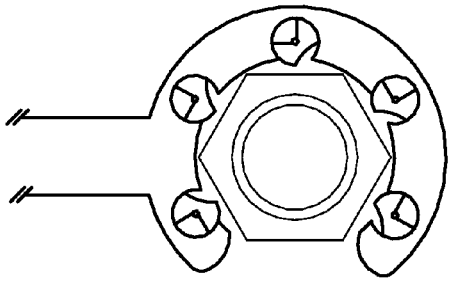

FIGS. 3D and 3E show cylinder cam arrangements suitable for flare nut wrenches which are useful for tightening nuts on tubing. A flare nut wrench is useful for brake lines, hydraulic lines, air conditioning, and higher pressure tubing. The wrench opening dimension 301 is designed to be larger than the tubing outside diameter, and the open end wrench is first slipped onto the tubing. Secondly, the wrench is then slipped onto the nut. The number of cylinder cams will vary depending upon the torque desired and the compactness of the wrench assembly.

Figure 4:
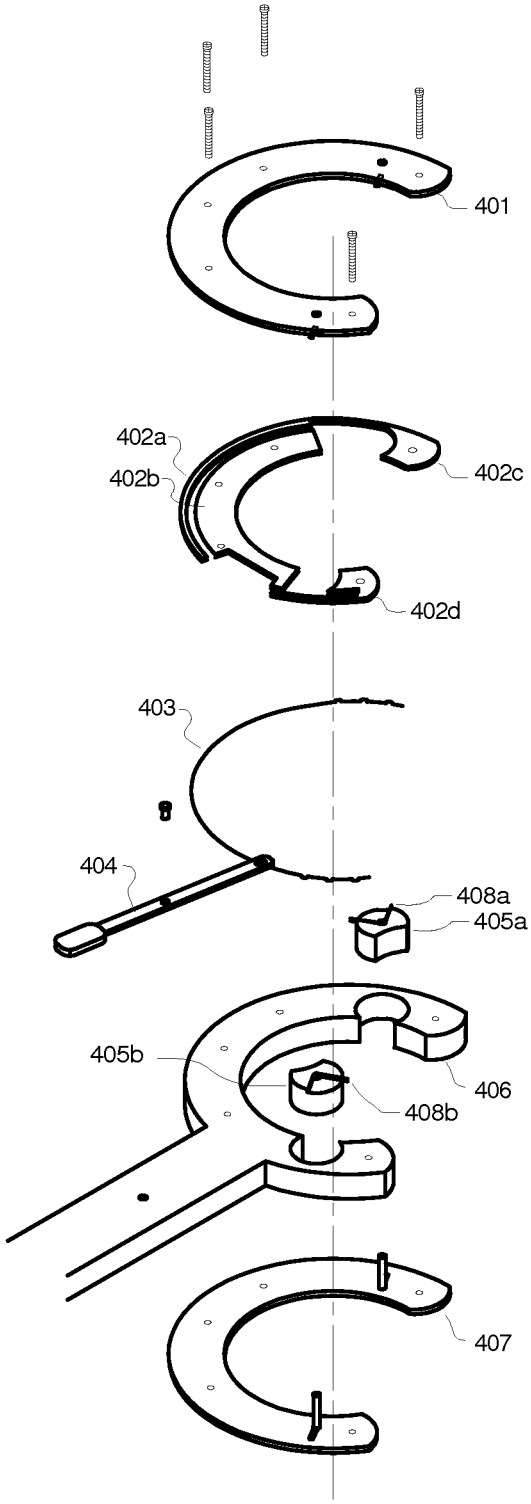
FIG. 4 shows an exploded view an embodied open end wrench assembly of the invention.

FIG. 4 shows an exploded view of an embodied assembly of the invention. The assembly comprises:

a) a bottom plate 407 b) a wrench body 406 c) two cylinder shaped cams 405*a,b* with torque springs 408*a,b* d) a slider arc 403 with attached reversing lever 404 e) two spacer plates 402*a,b* and two end spacer plates 402*c,d* f) a top plate 401

The assembly is completed by using screws.

Figure 5:
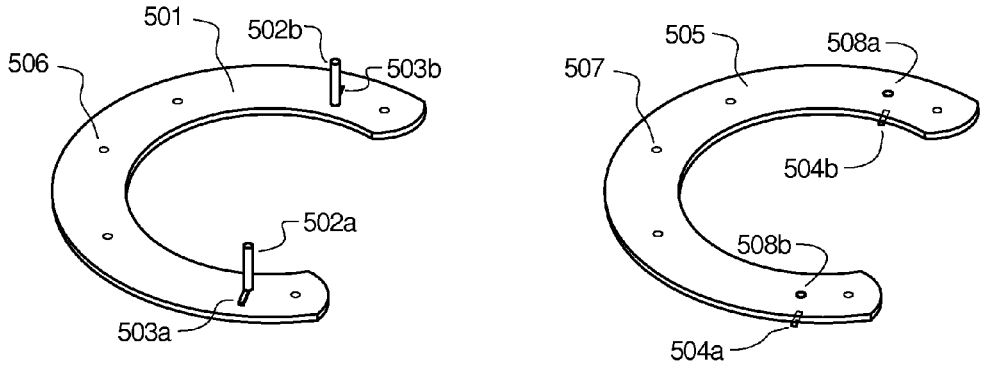
FIG. 5 shows details of the top and bottom plates.

FIG. 5 illustrates two plates that are used to work with the cylindrical cams and provide important features that make the ratchet effect functional. A bottom plate 501 is used with pins 502*a,b* which hold the cylindrical cams, not shown. Rotational stops 503*a,b* are used to prevent the cylindrical cams from rotating when they are engaged with the hex head bolt and provide torque. Threaded screw holes 506 in the bottom plate provide assembly. A top plate 505 similarly has rotational stops 504*a,b* for the cylindrical cams on the underside of the plate, but the pins 502*a,b* are inserted into holes 508*a,b* on the underside of the top plate during assembly. Similarly, through holes 507 provide assembly. Assembly is completed by screws, pins, longer rivets, or similar fasteners. Preferably, the assembly may be reparable by removing the screws. Although flat plates are illustrated, in some cases it is preferred to have an edge overhang (i.e. lip) so that the slider arc is contained where a spacer plate does not provide restraint. In other cases, it is desirable to have an edge overhang to contain one of the spacer plates.

Figure 6A:
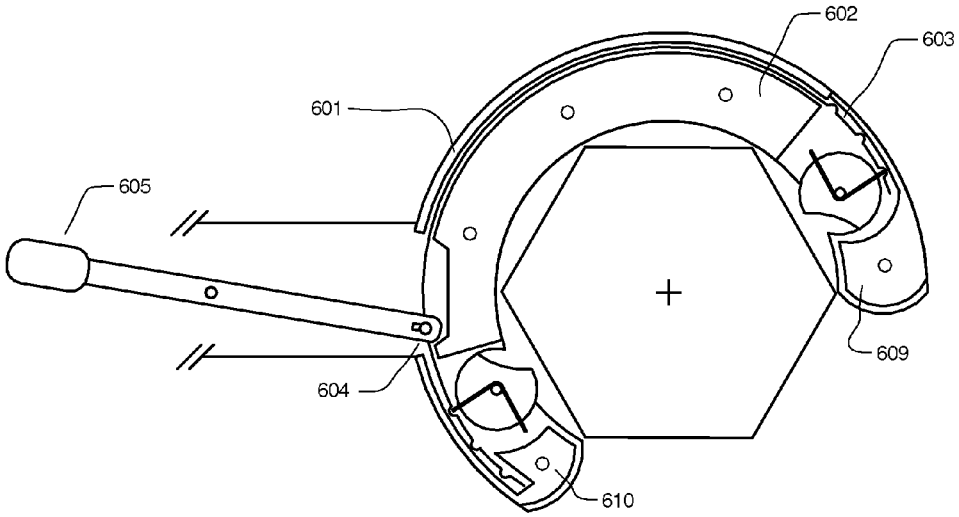
FIGS. 6A-6B show a detailed view of the slider wire and spacer plates.

FIG. 6A shows a partial detailed view of the wrench assembly with the top plate removed. An outer spacer 601 and an inner spacer 602 both are used to provide space between the top plate and the wrench body, and are gapped to guide the slider arc 603. The outer spacer 601 is held in place by machining the wrench body below it or by machining in the top plate. Two additional end spacer plates 609, 610 provide support for the top plate. The spacer plates provide enhanced reliability for the slider arc's function. As an alternate embodiment, one or all of the spacer plates are incorporated into the underside of the top plate. This simplifies the overall assembly, but complicates the manufacture of the top plate.

Figure 6B:
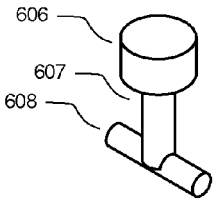

The attachment point 604 between the ratchet reversing lever 605 and the slider arc is done in a way that allows a radial connection with the slider arc and also allows axial movement along the lever lengthwise axis. This prevents binding with the lever motion. FIG. 6B shows a close-up of the button that is attached to the slider arc which is then fitted into the slot of the ratchet reverse lever. The top cap 606 can be snapped onto the rising vertical shaft 607 which is attached/bonded to the slider arc 608.

Figure 7A:
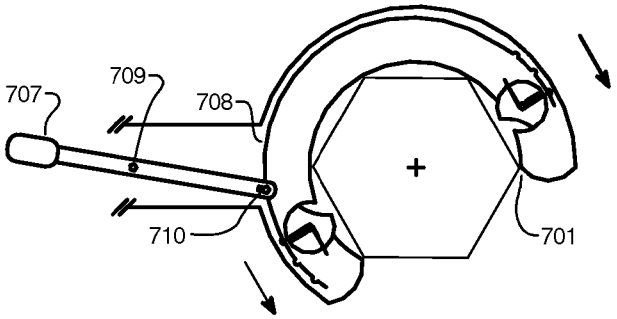
FIG. 7A-7D shows an embodiment of how the invention is used to torque a bolt, and additionally, how the ratchet effect works.

FIG. 7A shows the open end wrench being inserted onto a hex head bolt (or nut) and clearances 701 are provided by the design to facilitate the easy insertion onto the nut or bolt. This provides for the open end wrench to encompass the nut. Due to the particular design, only one size bolt will be manipulated per wrench design.

Figure 7B:
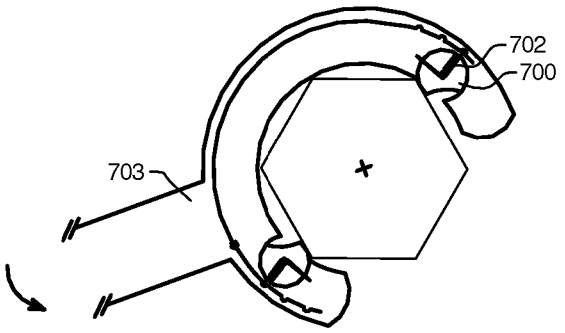

FIG. 7B shows the wrench rotated counter clockwise around the nut in the torque direction until the two cylindrical cams 700 are engaged on the sides of the hex head nut and this provides for torque application through the cylindrical cams. The cylindrical cams do not rotate as they are prevented from rotating by the rotational stops 702, which are anchored to the wrench body 703 via a top or bottom plate (not illustrated).

Figure 7C:
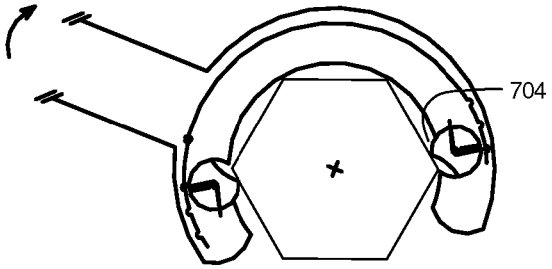
Figure 7D:
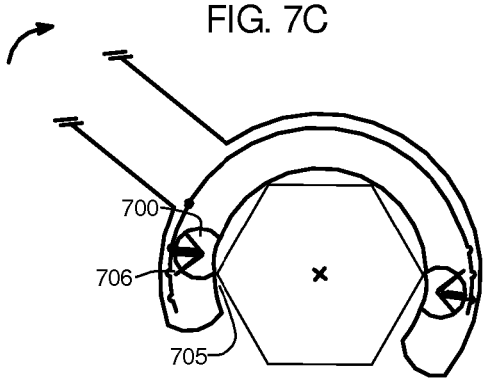
Figure 8A:
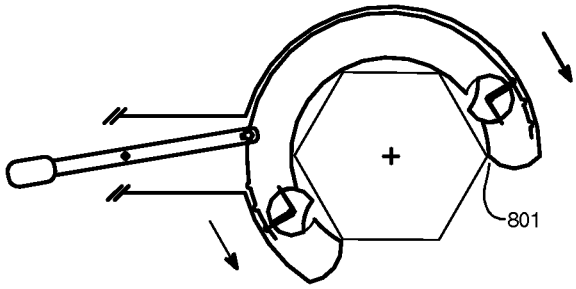
FIG. 8A-8D is similar to FIGS. 7A-7D, except that it is in the reverse direction.
Figure 8B:
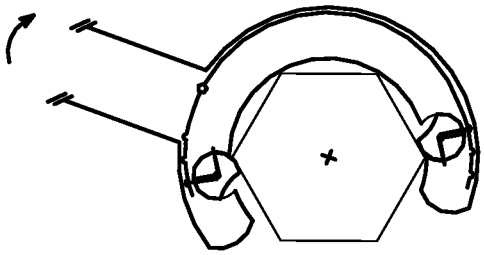
Figure 8C:
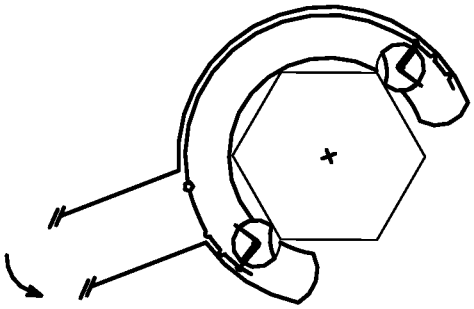
Figure 8D:
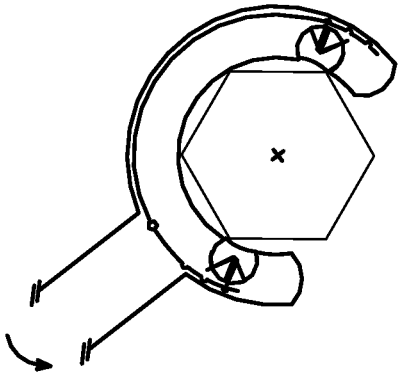

FIGS. 7C-7D illustrate the ratchet effect. FIG. 7C shows the wrench rotated clockwise around the nut in the ratchet direction until the cylindrical cams just begin to make contact 704 with the nut. FIG. 7D shows the wrench as it is continued to be turned in the ratchet direction, and the cylindrical cams 700 then rotate based on contact with the hex nut sides until the points of the hex head bolt pass by 705 the rotated cylindrical cams. The right angle spring 706 compresses angularly by about half, and once the hex head bolt passes through, returns the cylindrical cams to their original state of readiness as illustrated in FIG. 7A.

FIG. 7A also illustrates the reversing lever. A lever with an end knob 707 pivots around axis 709, and connects with reversing slider wire 708 at connecting point 710. The connecting point 710 allows the lever to move the wire radially about the perimeter of the wrench between the two cylindrical cams, but also allows the connection to slide axially along the axis of the lever. This prevents jamming of the wire at the connecting point.

For the sake of a simplified illustration, the reversing lever is only illustrated in FIG. 7A and is removed from FIGS. 7B-7D.

Similarly, FIG. 8A-8D shows the open end wrench being inserted onto a hex head bolt (or nut) using clearances 801 but with the ratchet lever in the opposite position.

Figure 9A:
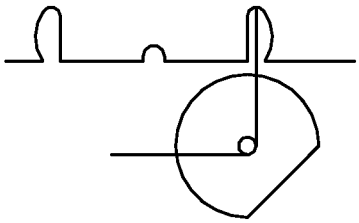
FIG. 9A-9E shows details of how the cylindrical cam, right angle spring, and slider arc are used to reverse the ratchet. And additionally, they show how the ratchet effect moves the right angle spring into the slider arc in the new position.
Figure 9B:
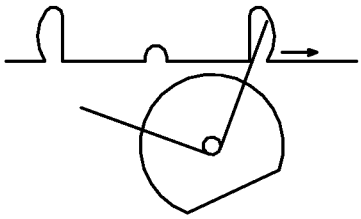
Figure 9C:
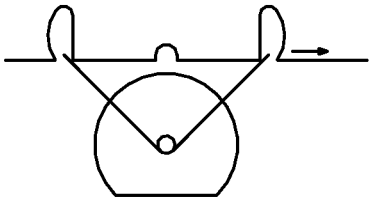
Figure 9D:
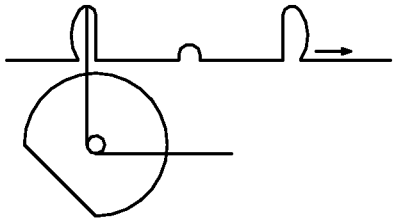
Figure 9E:
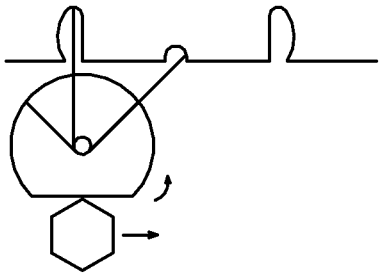

FIG. 9A-9E shows the details of how the cylindrical cam, right angle spring, and slider arc are used to reverse the ratchet. And additionally, they show how the ratchet effect moves the right angle spring into the slider arc in the new position. FIG. 9A shows the rotating cylindrical cam at the start. FIG. 9B show the cylindrical cam rotated 25 degrees when the sliding arc is moved. FIG. 9C show the cylindrical cam rotated 45 degrees as the sliding arc continues to be moved. FIG. 9D shows the cylindrical cam rotated 90 degrees as the sliding arc continues to be moved, and the ratchet effect is now reversed. FIG. 9E shows the cylindrical cam reverse rotated 45 degrees by a hex head bolt (illustrated very small), and the spring is rotated partially back into the sliding arc. As is illustrated, the sliding arc has incorporated a small bending arc to provide reliable spring action. The spring now is flexed, undergoes tension/compression, and opposes the rotating force. Once the bolt points pass, the spring will return the cylindrical cam to its original position in FIG. 9D, allowing the cylindrical cam to be in a position to either ratchet again or provide torque.

The right angle spring 201 of FIG. 2 is a flat torque spring bent in a curve to match the pin and cylindrical cam shape top to 90 degrees. The sides of the spring are longer than the radius of the cylindrical cam to ensure contact with the slider arc. Other right angle torque springs could equally be used.

No matter which position the ratchet lever set is set to, one half of the right angle spring will be against the rotational stop. The spring will only be put in tension (i.e. bent) when the cylindrical cam is in ratchet mode, i.e., when the wrench needs to pass by the points of the hex bolt (or nut). Note that the right angle spring that is resting against the rotational stop is also held in place by the slider wire.

The reversing lever allows the ratchet effect to be reversed when actively engaged with a bolt and the operator wants to tighten the bolt in opposite direction. This is very convenient when the wrench operator is initially confused as to the needed rotation of the bolt. This frequently comes up in various bolt tightening/loosening positions where the position is awkward or oriented in a way that is difficult for the operator to be sure of the direction.

Figure 10:
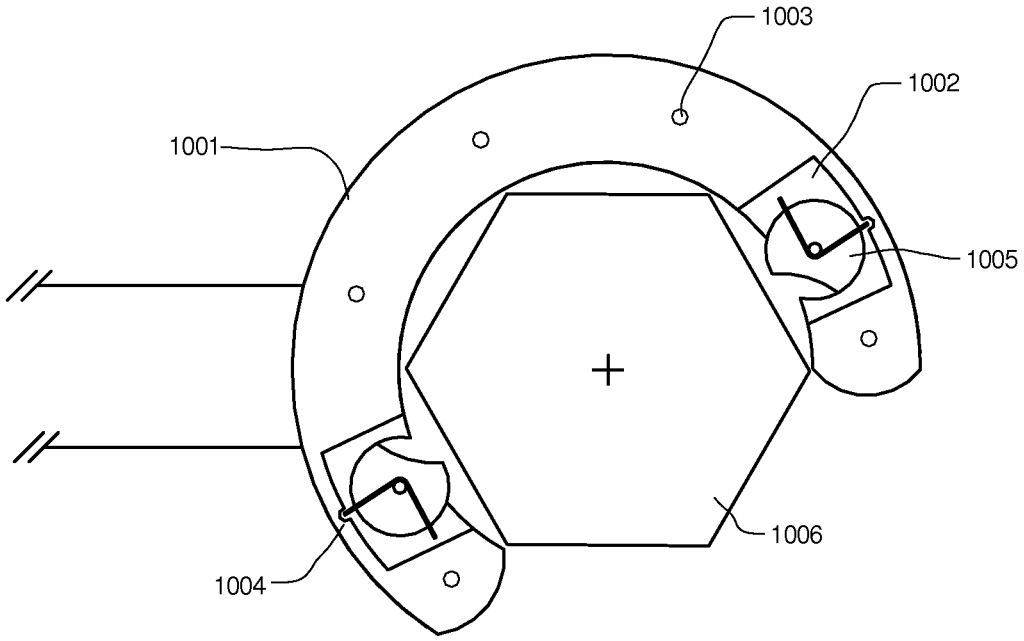
FIG. 10 is an embodiment of the invention that does not use a reversing lever.

FIG. 10 partial detailed view of the wrench assembly with the top plate removed. This embodiment is an embodiment that does not include a reversing lever to tighten the nut 1006 shown. A spacer plate 1001 is set on top of a wrench body 1002 with two cylinder cam assemblies 1005. Screw holes 1003 are used in the assembly of the open end ratchet wrench. The spacer plate includes notches 1004 that lock the right angle springs in place, allowing the cylinder cams to provide the reversing function as previously described.

Figure 11:
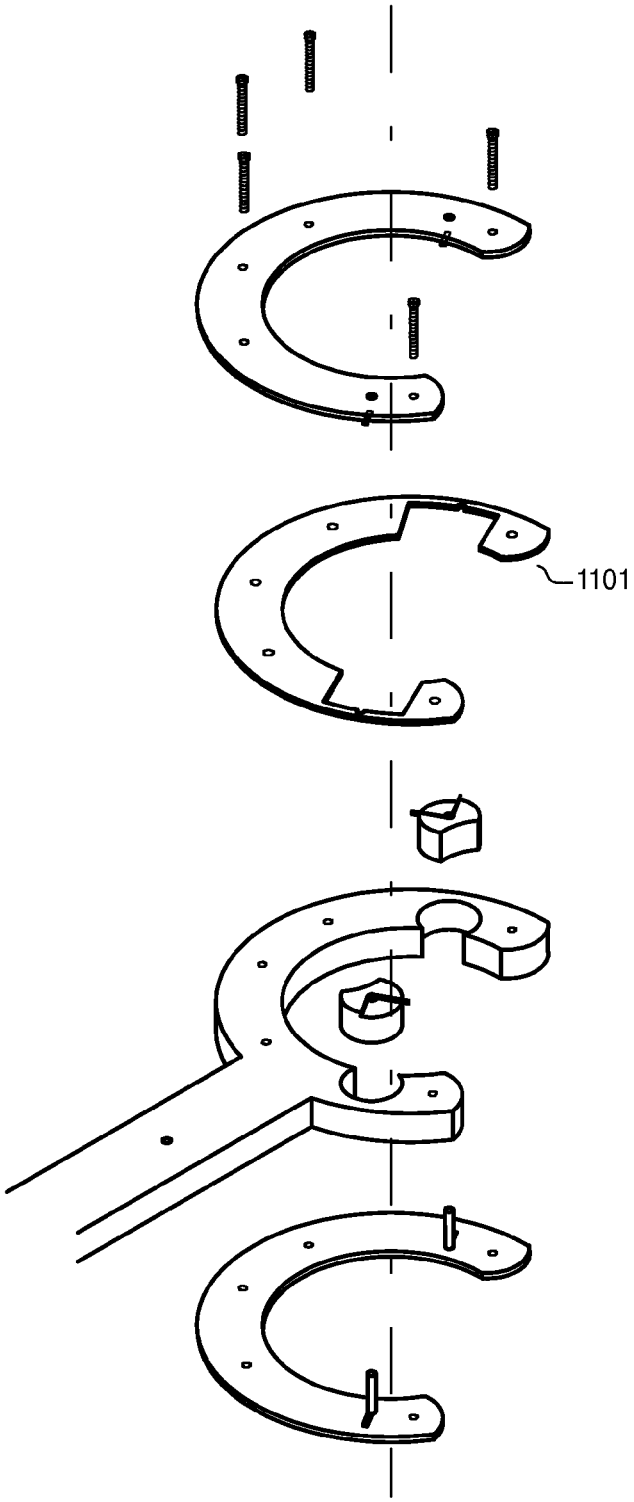
FIG. 11 is an exploded view of the embodiment that does not use the reversing lever.

FIG. 11 is an exploded view of the assembly without the reversing lever with the alternate spacer plate 1101. The primary difference between FIG. 11 and FIG. 4 is the alternate spacer plate and the reversing lever/slider arc are absent.

It should be noted that the term 'nut' is a meant as a term for either a nut or bolt head, since the open end wrench assembly is capable of turning either one, and the claims should be interpreted in light of their equivalency.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. An open end wrench assembly with a reversible ratchet feature comprising:

a) an opening within said open end wrench assembly designed to partially encompass a nut, b) wherein said open end wrench assembly has a plurality of cylindrical cams rotatably attached about an inner periphery of said opening, wherein said cylindrical cams incorporate the following design features:

1) wherein said cylindrical cams are arranged to grip said nut when the wrench is turned in the torque direction and to ratchet when turned in the ratchet direction, 2) wherein a portion of said cylindrical cams is machined in a manner to provide for engagement with said nut for the purpose of rotating said cylindrical cams for the ratchet function, and 3) a spring which is associated with each said cylindrical cam, wherein a rotation of said cylindrical cam by said ratchet function causes said spring to deflect and create a counter rotating force, c) a slider arc designed to rotate said springs and associated said cylindrical cams 90 degrees for the purpose of reversing the ratchet direction, d) a reversing lever attached to said slider arc designed to move said slider arc, e) a top plate and a bottom plate, and f) a plurality of spacer plates underneath said top plate, wherein said spacer plates are designed to guide said slider arc.

2. The open end wrench assembly according to claim 1 wherein said open end wrench assembly is assembled by screws.

3. The open end wrench assembly according to claim 1 wherein said springs are right angle torque springs.

4. The open end wrench assembly according to claim 1 wherein said bottom plate incorporates at least two pins and at least two bottom rotating stops.

5. The open end wrench assembly according to claim 4 wherein said top plate incorporates at least two holes for said pins and at least two top rotating stops.

6. The open end wrench assembly according to claim 5 wherein said cylindrical cams are mounted on said pins.

7. The open end wrench assembly according to claim 1 wherein said reversing lever is attached to said slider arc by use of an axial slot and a large button attached to said slider arc.

8. The open end wrench assembly according to claim 1 wherein said slider arc touches a plurality of reversing springs.

9. The open end wrench assembly according to claim 2 wherein said nut is mounted on tubing.

10. The open end wrench assembly according to claim 9 wherein said open end wrench assembly is a flare nut wrench.

11. The open end wrench assembly according to claim 1 wherein said spacer plates are incorporated into said top plate.

12. An open end wrench assembly with a ratchet feature comprising:

a) an opening within said open end wrench assembly designed to partially encompass a nut, b) wherein said open end wrench assembly has a plurality of cylindrical cams rotatably attached about an inner periphery of said opening, wherein said cylindrical cams incorporate the following design features:

1) wherein said cylindrical cams are arranged to grip said nut when the wrench is turned in the torque direction and to ratchet when turned in the ratchet direction, 2) wherein a portion of said cylindrical cams is machined in a manner to provide for engagement with said nut for the purpose of rotating said cylindrical cams for the ratchet function, 3) a spring which is associated with each said cylindrical cam, wherein a rotation of said cylindrical cam by said ratchet function causes said spring to deflect and create a counter rotating force, c) a top plate and a bottom plate, d) a spacer plate underneath said top plate, wherein said spacer plate are designed to engage said spring, e) wherein said springs are right angle torque springs, f) wherein said bottom plate incorporates at least two pins and at least two bottom rotating stops, g) wherein said cylindrical cams are mounted on said pins, and g) wherein said top plate incorporates at least two holes for said pins and at least two top rotating stops.

13. The open end wrench assembly according to claim 12 wherein said nut is mounted on tubing.

14. The open end wrench assembly according to claim 13 wherein said open end wrench assembly is a flare nut wrench.

15. The open end wrench assembly according to claim 12 wherein said spacer plate is incorporated into said top plate.

* * * * *